US009609405B2

(12) United States Patent
Fincham

(10) Patent No.: US 9,609,405 B2
(45) Date of Patent: Mar. 28, 2017

(54) SLIM PROFILE LOUDSPEAKER

(71) Applicant: THX Ltd, San Francisco, CA (US)

(72) Inventor: Lawrence R. Fincham, Santa Rosa, CA (US)

(73) Assignee: THX Ltd., San Francisco, CA (US)

( * ) Notice: Subject to any disclaimer, the term of this patent is extended or adjusted under 35 U.S.C. 154(b) by 173 days.

(21) Appl. No.: 14/203,410

(22) Filed: Mar. 10, 2014

(65) Prior Publication Data

US 2014/0314249 A1 Oct. 23, 2014

Related U.S. Application Data

(60) Provisional application No. 61/780,521, filed on Mar. 13, 2013.

(51) Int. Cl.

| | |
|---|---|
| ***H04R 1/02*** | (2006.01) |
| ***H04R 1/28*** | (2006.01) |
| ***H04R 1/40*** | (2006.01) |
| ***H04R 5/02*** | (2006.01) |

(52) U.S. Cl.

CPC ..... *H04R 1/02* (2013.01); *H04R 1/2869* (2013.01); *H04R 1/403* (2013.01); *H04R 5/02* (2013.01)

(58) Field of Classification Search

CPC ..... H04R 1/02; H04R 1/2869; H04R 1/403; H04R 2/02; H04R 5/02

USPC ..... 381/89, 87, 386, 387

See application file for complete search history.

(56) References Cited

U.S. PATENT DOCUMENTS

| | | | |
|---|---|---|---|
| 2,440,078 | A | 4/1948 | Devine |
| 2,694,462 | A | 11/1954 | Robbins et al. |
| 3,371,742 | A | 3/1968 | Norton et al. |
| 3,687,220 | A | 8/1972 | Virva |
| 4,029,170 | A | 6/1977 | Phillips |
| 4,031,318 | A | 6/1977 | Pitre |
| 4,131,179 | A | 12/1978 | Pope |
| 4,196,790 | A | 4/1980 | Reams |
| 4,322,578 | A | 3/1982 | Selmin |
| 4,334,593 | A | 6/1982 | Sechrist |

(Continued)

OTHER PUBLICATIONS

Messenger, Paul, Subjective Sounds, Hi-Fi News & Record Review, Sep. 1984, pp. 29 and 31.

(Continued)

*Primary Examiner* — Xu Mei
*Assistant Examiner* — Ammar Hamid
(74) *Attorney, Agent, or Firm* — Ben J. Yorks; Irell & Manella LLP

(57) ABSTRACT

A narrow-profile balanced subwoofer or similar speaker includes a number of drivers placed side by side in the same lateral plane, with a first set of drivers facing one direction and second set of drivers facing the opposite direction. Their orientation is such that the sum of the forces from the first set of drivers is equal and opposite the sum of the forces from the second set of drivers, thus cancelling, and the sum of the moments from all of the drivers about a center or pivot point substantially equals zero. The speaker may include three or more drivers, symmetrically or asymmetrically spaced. The drivers may be of the same or different sizes, and the audio signal amplitudes may be adjusted to help balance the speaker. Each set of drivers may output sound into separate sound ducts, which may output sound from one or more apertures.

42 Claims, 7 Drawing Sheets

(56) References Cited

U.S. PATENT DOCUMENTS

| | | | | |
|---|---|---|---|---|
| 4,398,619 | A | | 8/1983 | Daniel |
| 4,474,258 | A | | 10/1984 | Westlund |
| 4,620,317 | A | | 10/1986 | Anderson |
| 4,628,528 | A | | 12/1986 | Bose et al. |
| 4,722,418 | A | | 2/1988 | Peeters |
| 4,748,669 | A | | 5/1988 | Klayman |
| 4,837,839 | A | | 6/1989 | Andrews |
| 4,846,382 | A | | 7/1989 | Foultner et al. |
| 4,866,774 | A | | 9/1989 | Klayman |
| 4,893,695 | A | | 1/1990 | Tamura et al. |
| 4,903,300 | A | | 2/1990 | Polk |
| 5,036,946 | A | | 8/1991 | Yoshino |
| 5,067,159 | A | | 11/1991 | Kasai et al. |
| 5,073,945 | A | | 12/1991 | Kageyama et al. |
| 5,115,470 | A | | 5/1992 | Sutheim |
| 5,138,526 | A | | 8/1992 | Chung Hsiang |
| 5,199,075 | A | | 3/1993 | Fosgate |
| 5,306,880 | A | | 4/1994 | Coziar |
| 5,400,408 | A | | 3/1995 | Lundgren et al. |
| 5,432,860 | A | | 7/1995 | Kasajima et al. |
| 5,451,726 | A | | 9/1995 | Haugum |
| 5,471,018 | A | | 11/1995 | Nieuwendijk et al. |
| 5,517,574 | A | | 5/1996 | Tichy |
| 5,561,717 | A | | 10/1996 | Lamm |
| 5,610,992 | A | | 3/1997 | Hickman |
| 5,727,066 | A | | 3/1998 | Elliott et al. |
| 5,745,586 | A | | 4/1998 | Tagami et al. |
| 5,749,433 | A | | 5/1998 | Jackson |
| 5,850,460 | A | * | 12/1998 | Tanaka ..... H04R 1/2873 381/182 |
| 5,862,227 | A | | 1/1999 | Orduna-Bustamante et al. |
| 5,870,485 | A | | 2/1999 | Lundgren et al. |
| 5,902,023 | A | | 5/1999 | Yu et al. |
| 5,929,393 | A | | 7/1999 | Jeter et al. |
| 5,930,376 | A | | 7/1999 | Markow et al. |
| 5,943,431 | A | | 8/1999 | Weiss et al. |
| 5,949,894 | A | | 9/1999 | Nelson et al. |
| 6,307,947 | B1 | | 10/2001 | Wiener |
| 6,415,035 | B1 | | 7/2002 | Shin et al. |
| 6,510,919 | B1 | | 1/2003 | Roy et al. |
| 6,674,864 | B1 | | 1/2004 | Kitamura |
| 6,687,380 | B1 | | 2/2004 | Vishwamitra |
| 6,739,424 | B2 | | 5/2004 | Ogura et al. |
| 6,771,787 | B1 | | 8/2004 | Hoefler et al. |
| 6,798,891 | B1 | | 9/2004 | Sadaie et al. |
| 6,985,593 | B2 | | 1/2006 | Nichols et al. |
| 7,010,138 | B1 | | 3/2006 | Harris et al. |
| 7,254,239 | B2 | | 8/2007 | Fincham |
| 7,292,702 | B2 | | 11/2007 | Hagman |
| 7,316,290 | B2 | | 1/2008 | Hutt et al. |
| 7,353,907 | B2 | | 4/2008 | Whitaker |
| 7,433,483 | B2 | | 10/2008 | Fincham |
| 7,457,425 | B2 | | 11/2008 | Fincham |
| 7,463,746 | B2 | | 12/2008 | Caron et al. |
| 7,526,093 | B2 | | 4/2009 | Devantier et al. |
| 7,840,018 | B2 | | 11/2010 | Prenta et al. |
| 7,974,425 | B2 | | 7/2011 | Fincham |
| 8,027,500 | B2 | | 9/2011 | Fincham |
| 8,135,158 | B2 | | 3/2012 | Fincham |
| 8,280,076 | B2 | | 10/2012 | Devantier et al. |
| 8,457,340 | B2 | | 6/2013 | Fincham |
| 2002/0153193 | A1 | | 10/2002 | Toki |
| 2003/0179891 | A1 | | 9/2003 | Rabinowitz et al. |
| 2003/0219137 | A1 | | 11/2003 | Fincham |
| 2005/0031135 | A1 | | 2/2005 | Devantier et al. |
| 2005/0129258 | A1 | | 6/2005 | Fincham |
| 2007/0081680 | A1 | * | 4/2007 | Yen ..... H04R 1/403 381/182 |

OTHER PUBLICATIONS

Colloms, Martin, An Exercise in Conjugation, the KEFR104/2, Hi-Fi News & Record Review, Sep. 1984, pp. 53, 55-57.

* cited by examiner

SLIM PROFILE LOUDSPEAKER

RELATED APPLICATION INFORMATION

This application claims the benefit of U.S. Provisional Application Ser. No. 61/780,521, filed on Mar. 13, 2013, hereby incorporated by reference as if set forth fully herein.

BACKGROUND OF THE INVENTION

Field of the Invention

The field of the present invention relates to sound reproduction and, more specifically, to speaker configurations and enclosures.

Background of the Related Art

Many sound reproduction systems include a subwoofer loudspeaker for reproducing very low frequency audio signals. Subwoofers may find use in a variety of settings including home audio systems, automobile sound systems, cinema audio systems, home theater systems, and live performance sound systems, among others.

Despite their popularity, conventional subwoofers suffer from a number of potential drawbacks or disadvantages. For example, subwoofer speakers can take up an inordinate amount of space. The size and shape of subwoofer speaker cabinets can be difficult to place in listening areas of limited size or with structural limitations, such as in automobiles and in many home environments. A common subwoofer cabinet is generally cubic in shape, and can be difficult to place in speaker cabinets or within the confines of an automobile, or in other limited spaces.

It is commonly understood that a subwoofer that for optimal sound reproduction of very low frequencies, a subwoofer driver should be relatively large in diameter, as compared with other drivers (for high- and mid-range frequencies for instance), which in turn means that the driver will generally have a relatively deep cone. It is also typical to construct a subwoofer speaker enclosure with a large cavity to allow the driver adequate ability to move an appropriate volume of air. Together these considerations often lead to subwoofer cabinets of bulky design that do not fit easily in limited spaces.

Another problem with subwoofer speakers is that they can create undesirable vibrations of nearby objects, in part because of the relatively large and forceful excursions made by the subwoofer driver as it reproduces very low frequency sounds. This phenomenon may not be as noticeable with standalone subwoofer speaker cabinets, but manifests more commonly in subwoofers that are designed as integral components of a larger structure, such as recessed subwoofers that are built into a wall of a home or building, or subwoofer loudspeakers that are integrated into an automobile. Because subwoofers in these settings are directly or indirectly physically attached to a building structure or automobile frame, their deep vibrations can be carried through the structure or framing to other items attached thereto or to adjoining rooms in a house or structure, causing noticeable rattling or even forcing objects to move or causing damage. The vibrations from the very lower frequencies reproduced by a subwoofer can be easily transmitted through a house or building while the higher frequencies are dampened, causing deep vibrations that can disturb other occupants or neighbors.

Standalone subwoofer speaker cabinets can also suffer from similar problems. Standalone speaker cabinets are sometimes placed in discreet or unobtrusive locations such as in room corners, low cabinets, and the like, but due to their excessive vibrations they have limited ability to serve other functions. For example, objects placed on standalone speaker enclosures may rattle noticeably, gradually slide across the surface, or fall off, causing annoying noise or damaging the objects.

Some subwoofer loudspeakers include two (or more) drivers, which may be done in order to increase sound output or, in some designs, to reduce vibrations of the cabinet or enclosure. When two drivers are oriented so that they directly face one another, the motion of the drive units is symmetric and the opposing movements of the two drivers may cancel out, reducing the vibration of the cabinet or enclosure. One drawback with this type of design, however, is that the speaker cabinet or enclosure must be deep enough to contain two face-to-face drivers, which can lead to even larger, bulkier cabinets or enclosures that are harder to place in limited spaces. Thus, consumers and sound system designers are often left with the choice of tolerating some level of cabinet/enclosure vibration, or else having to find placement for a large, bulky subwoofer loudspeaker.

It would be advantageous to provide a subwoofer or similar speaker design that has a narrower profile, so that it can be utilized in smaller or narrower spaces. It would further be advantageous to provide a subwoofer with reduced vibration while maintaining a high level of sound output and fidelity. It would further be advantageous to provide a subwoofer that is well suited for use as a recessed speaker in a home or building, or in the confines of an automobile.

SUMMARY OF THE INVENTION

In one aspect, a subwoofer or other speaker is provided having multiple drivers which are oriented and driven in a manner such that the forces and/or moments created by the driver motion substantially cancel, thereby, among other things, reducing or eliminating undesired vibrations of the speaker housing or enclosure.

According to one or more embodiments, a subwoofer or other speaker includes a number of drivers placed side by side in the same general plane, with a first set of drivers facing one direction and second set of drivers facing the opposite direction. The drivers are preferably oriented such that the sum of the forces from the first set of drivers is equal to and opposite from the sum of the forces from the second set of drivers with the total vector sum of the forces from all of the drivers equaling zero, and such that the vector sum of the moments from all of the drivers about a centerpoint collectively equals zero.

A subwoofer or other speaker may include any number of drivers, with a minimum of three drivers being used in certain embodiments to ensure that the moment created between two opposing offset drivers can be canceled through the addition of at least one additional offset driver. A subwoofer or other speaker according to certain principles described herein may include three, four, five, six, or even more drivers. The subwoofer speaker need not be symmetric in shape, but can be asymmetrical so long as the forces and moments are such that they cancel about the centerpoint or center of mass of the speaker. Similarly, while the drivers are preferably arranged in the same general plane, they may alternatively be arranged in a three-dimensional pattern so long as the forces and moments are such that they cancel about the centerpoint or center of mass of the speaker.

In some embodiments, a first set of drivers and second set of drivers lie in the same general plane but face opposite from one another. Each set of drivers may output sound towards a reflective surface which in turn directs the sound outward from an adjacent slot or aperture. A speaker enclosure may be constructed with a connected aperture so that sound from the two sets of drivers is combined and emanates from a single aperture or set of apertures common to both sets of drivers.

In certain embodiments, a subwoofer or other speaker is constructed with a lightweight but rigid and sturdy enclosure in which the walls are formed in part from a frame overlaid with an acoustically opaque material. For example, the speaker enclosure may be comprised of a series of frame supports arranged in a repeating pattern, such as a honeycomb pattern, covered or overlaid with an acoustically opaque material. Each driver or set of drivers may have its or their own isolated enclosure, so as to prevent the rearward acoustic radiation of the driver(s) from interfering with the other drivers of the speaker.

Further embodiments, alternatives and variations are also described herein or illustrated in the accompanying figures.

DETAILED DESCRIPTION OF PREFERRED EMBODIMENTS

According to one or more embodiments, a subwoofer speaker system is provided having multiple drivers which are oriented in different directions and selectively driven in a manner such that the magnet reaction forces and moments created by the driver motion substantially cancel out, thus reducing or eliminating undesired vibrations of the speaker housing or enclosure.

In one embodiment, a subwoofer speaker includes a first set of drivers facing one direction and second set of drivers facing the opposite direction, with the first and second sets of drivers arranged in the same general plane so that the depth of the speaker housing or enclosure is reduced. As each driver's cone or diaphragm moves back and forth, the driver generates a first force which propels the cone or diaphragm and an equal but opposite second force applied to the speaker housing or enclosure that supports the driver's frame or chassis. Drivers oriented directly opposite one another can, if balanced, create forces that cancel one another and hence reduce vibrations. However, drivers that are located off-center from the centerpoint or center of gravity of the speaker housing or enclosure will tend to generate a turning effect, i.e., a moment associated with the magnet reaction force, that can nonetheless cause undesired vibrations.

To reduce or eliminate such vibrations, the drivers are preferably oriented and arranged such not only is the sum of the forces from the first set of drivers is equal to and opposite from the sum of the forces from the second set of drivers, but also so that the vector sum of the moments from all of the drivers about a centerpoint or center of gravity collectively equals zero.

Although a subwoofer speaker according to embodiments as disclosed herein may include any number of drivers, it is generally anticipated that a minimum of three drivers would be used to provide cancellation of the forces and moments among the drivers, so that, for example, the moment created between two opposing offset drivers can be canceled through the addition of at least one additional offset driver. A subwoofer speaker may include three or more drivers in either symmetric or asymmetric arrangement, preferably but not necessarily aligned in the same general plane.

In addition, in at least some embodiments the drivers output sound towards a reflective surface which turns and directs the sound outward from a nearby output slot or aperture. A speaker enclosure may be constructed with a connected aperture so that sound from the two sets of drivers is combined and emanates from a single aperture or set of apertures common to both sets of drivers.

Figure 1A:
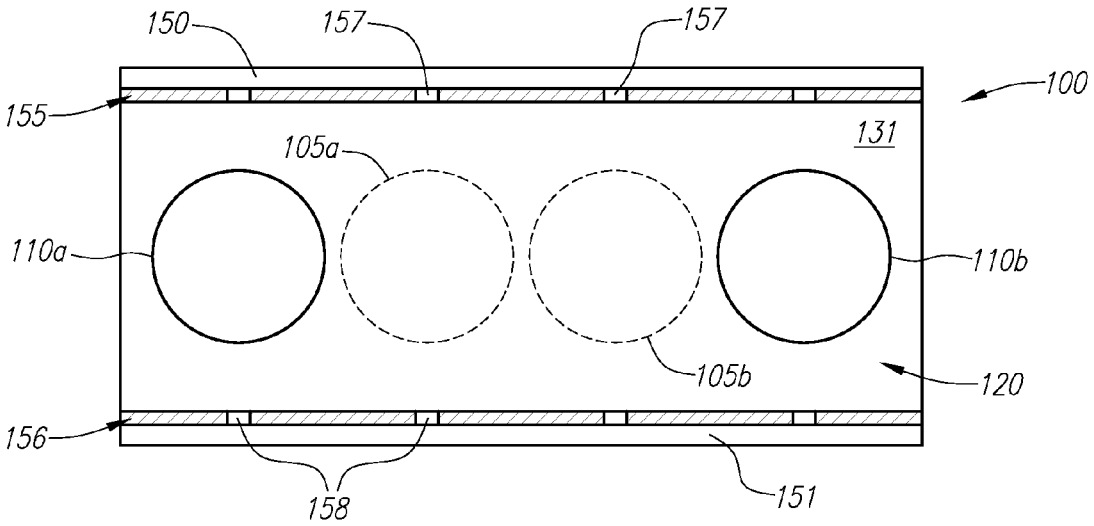
FIG. 1A is a front view diagram of one embodiment of a slim-profile subwoofer speaker with four drivers and a common output aperture.
Figure 1B:
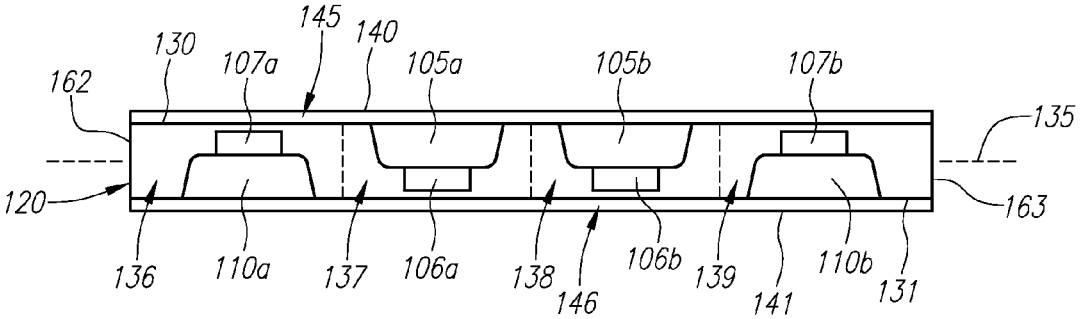
FIGS. 1B and 1C are top-view and side-view cross-sectional diagrams, respectively, of the speaker of FIG. 1A.
Figure 1C:
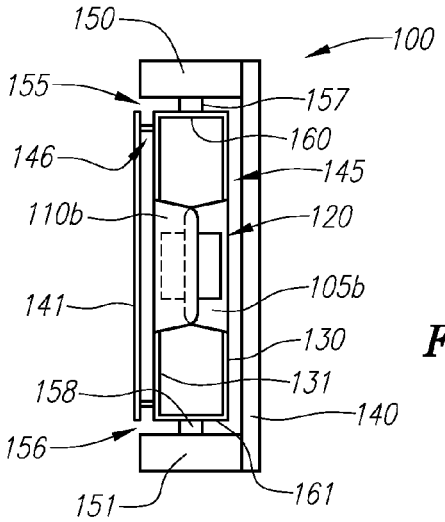

An example of a slim-profile sub-woofer speaker 100 constructed according to one embodiment is disclosed herein is illustrated in FIGS. 1A-1C. FIG. 1A is a front view diagram of the slim-profile sub-woofer speaker 100 (shown without a sound-reflective front cover, as explained later), while FIGS. 1B and 1C are top-view and side-view diagrams, respectively, of the speaker 100. As shown therein, the speaker 100 in this example includes four drivers 105*a*, 105*b*, 110*a*, 110*b* mounted in a main speaker enclosure 120. The speaker enclosure 120 in this example includes a first baffle 130 containing holes for mounting two of the drivers 105*a*, 105*b*, and a second baffle 131 for containing holes for mounting the other two of the drivers 110*a*, 110*b*, such that the first pair of drivers 105*a*, 105*b* are mounted in the opposite direction from the second pair of drivers 110*a*, 110*b*, although all four drivers 105*a*, 105*b*, 110*a*, 110*b* are mounted in the same general plane 135, i.e., the cones of the drivers 105*a*, 105*b*, 110*a*, 110*b* all overlap even though they do not all face the same direction. The first pair of drivers 105*a*, 105*b* are preferably symmetrically mounted to either side of the center of the speaker enclosure 120, while the second pair of drivers 110*a*, 110*b* are preferably symmetrically mounted to either side of drivers 105*a*, 105*b* respectively, and thus are likewise symmetrically mounted about the center of the speaker enclosure 120.

The first baffle 130 and second baffle 131 form opposing walls of the main speaker enclosure 120, which in this example is further divided into four chambers comprising two outer chambers 136, 137 and two inner chambers 138, 139. The four chambers 136-139 preferably provide acoustical isolation such that the motion of any of the drivers 105*a*, 105*b*, 110*a*, 110*b* during speaker operation does not interfere with an adjacent driver, and more specifically so that the rearward acoustic radiation from any of the drivers 105*a*, 105*b*, 110*a*, 110*b* does not interfere with any other driver. The main speaker enclosure 120 may further comprise top wall 160 and bottom wall 161 (as shown in FIG. 1C), and side walls 162, 163 (as shown in FIG. 1B), to form a complete enclosure. The size of chambers 136-139 is preferably selected to allow adequate movement of the drivers 105*a*, 105*b*, 110*a*, 110*b*, and in particular, the width of separation between the first baffle 130 and second baffle 131 is preferably sufficient to allow the coils 107*a*, 107*b* of drivers 110*a*, 110*b* to vibrate without hitting the first baffle 130 and to allow the coils 106*a*, 106*b* of drivers 105*a*, 105*b* to vibrate without hitting the second baffle 131.

Thus, the width of the speaker enclosure 120 can, if desired, be made significantly thinner than, for example, a speaker in which two drivers are mounted directly facing one another, in which case the thickness must account not only for the size of two drivers but also the range of motion of the coils of both drivers.

Although not necessary in all embodiments, in the example of a speaker 100, the main speaker enclosure 120 is surrounded by an outer structure that includes a cabinet top wall 150, cabinet bottom wall 151, cabinet backwall 140, and cabinet front panel 141, spaced apart from the main speaker enclosure 120 so as to define various sound ducts as described below which direct the acoustic output so that it emanates from top and bottom sound apertures 155, 156. The outer speaker cabinet may share side walls 162, 163 with the main speaker enclosure 120, and may be further structurally connected to the main speaker enclosure 120 via struts 157 and 158.

In operation, the drivers 105*a*, 105*b*, 110*a*, 110*b* output sound towards a rigid sound-reflecting surface which, in each case, turns the acoustic output by ninety degrees and directs it towards an output aperture. More specifically, the first pair of drivers 105*a*, 105*b* output sound towards a first rigid surface constituting the speaker cabinet backwall 140, and the second pair of drivers 110*a*, 110*b* output sound towards a second rigid surface constituting the speaker cabinet front panel 141. The mounting baffle 130 and speaker cabinet backwall 140 collectively define a relatively narrow sound duct 145 which forces the acoustic output outward at ninety degrees relative to the first pair of drivers 105*a*, 105*b*, while mounting baffle 140 and speaker cabinet front panel 141 collectively define another relatively narrow sound duct 146 which forces the acoustic output outward at ninety degrees relative to the second pair of drivers 110*a*, 110*b*. In this particular design, the output from the first pair of drivers 105*a*, 105*b* is turned at ninety degrees a second time such that the acoustic energy exits the rear sound duct 145 and proceeds to flow through and exit from top and bottom sound apertures 155, 156. Similarly, the acoustic output from drivers 110*a*, 110*b* that flows through front sound duct 146 also exits via top and bottom sound apertures 155, 156, so that the sound from all four drivers 105*a*, 105*b*, 110*a*, 110*b* exits from top and bottom sound apertures 155, 156.

Figure 5A:
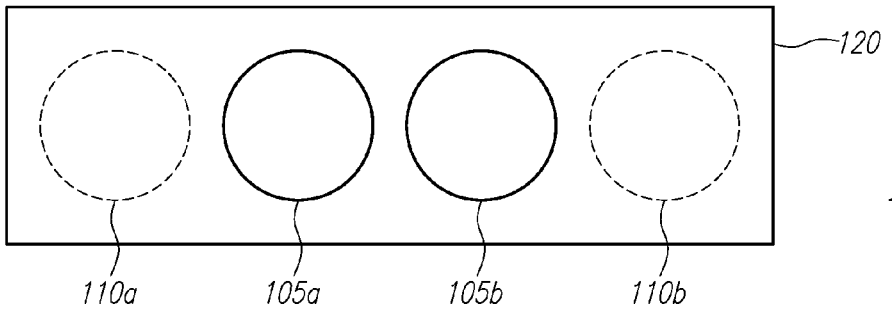
FIGS. 5A and 5B are front and side view diagrams, respectively, of another embodiment of a slim-profile sub-woofer speaker having four drivers.
Figure 5B:
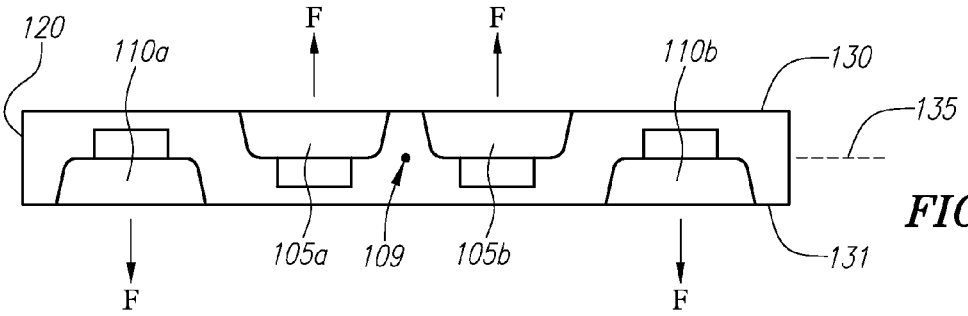

In the embodiment of FIGS. 1A-1C, if all four drivers 105*a*, 105*b*, 110*a*, 110*b* are provided with an equal strength identical signal, then their relative motion will cancel out the various forces and moments so that vibration can be advantageously reduced or eliminated. This effect can be explained with reference to FIGS. 5A and 5B, which show a simplified diagram of the basic speaker design of FIGS. 1A-1C, and FIG. 10, which illustrates the cancellation of opposing moments generated by the simultaneous forces of the four drivers 105*a*, 105*b*, 110*a*, 110*b*. FIGS. 5A and 5B illustrate, among other things, the effect of providing a equal strength identical signal to the four drivers 105*a*, 105*b*, 110*a*, 110*b*. As is well known in the art, a typical driver includes a cone or diaphragm with a coil attached to its back side, all mounted in a frame or chassis. A suspension system associated with the driver allows the coil to move back and forth in a gap, like a piston. Electrical audio signals magnetically energize the coil which in turn vibrates the cone or diaphragm back and forth, creating an opposing force on the frame or chassis that gets conveyed to the speaker housing or enclosure supporting the driver's frame or chassis. The driver's suspension system provides a restoring force that returns the cone or diaphragm to a neutral position after moving.

In the present example, the forward motion of drivers 105*a*, 105*b* creates a "downward" motion (according to FIG. 5B) on the speaker housing or enclosure 120, while the forward motion of drivers 110*a*, 110*b* creates an "upward" motion on the speaker housing or enclosure 120. Since each driver 105*a*, 105*b*, 110*a*, 110*b* is driven by an identical signal, and assuming that each driver 105*a*, 105*b*, 110*a*, 110*b* has the same physical and electrical characteristics, the downward forces on the speaker housing or enclosure 120 cancel the upward forces, thus reducing or eliminating vibrations. The same phenomenon occurs when the restoring force of the suspension systems moves the driver's cones or diaphragms back towards a neutral position, with the restoring forces of drivers 105*a*, 105*b* canceling those of drivers 110*a*, 110*b*.

Drivers 105*a*, 105*b*, 110*a*, 110*b* are further preferably arranged and positioned so that the moments generated by the forces associated with their forward and backward movement collectively cancel out. This phenomenon can be explained with reference to FIG. 10. The centerpoint (CP) or center of gravity of the speaker enclosure 120 is shown relative to the locations of the drivers 105*a*, 105*b*, 110*a*, 110*b*. Each of drivers 105*a*, 105*b*, 110*a*, 110*b* is physically offset from the centerpoint (CP) and so each will generate a moment as it moves. In general, the moment of each driver is equal to the vector cross-product $r \times F$, where r is the vector from the centerpoint (CP) to the center of mass of the driver in question, and F is the force created by the driver. In this example, since the drivers 105*a*, 105*b*, 110*a*, 110*b* are substantially in the same plane 135 which traverses through the centerpoint (CP), and since the force F is generally perpendicular to the plane of the driver, the vector cross-product will be the product of the distance of the driver to the centerpoint (CP) and the force F. However, where the drivers do not lie in the same plane, evaluation of the various moments may be made using the vector cross product instead. There is no inherent requirement that all drivers be aligned in the same plane.

Figure 10:
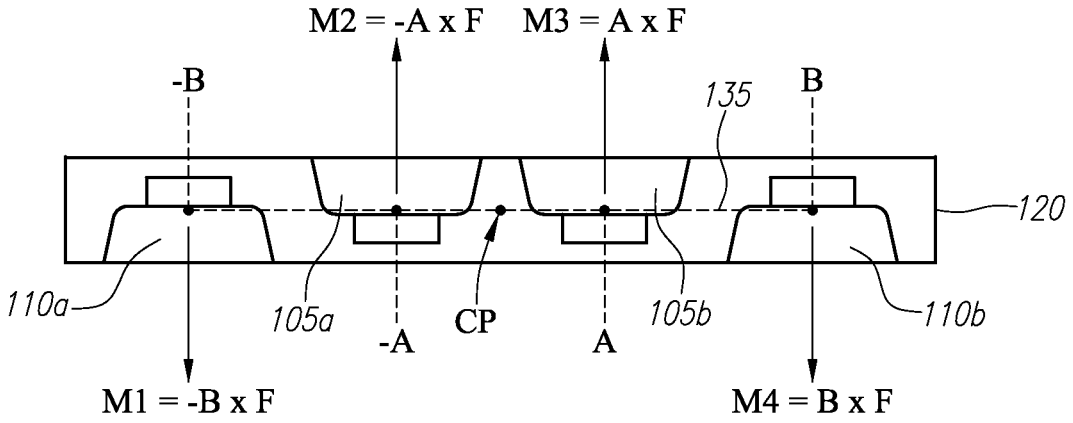
FIG. 10 is a simplified diagram illustrating the cancellation of forces and moments for a speaker having four drivers operating in accordance with an embodiment as disclosed herein.

In the example of FIG. 10, it is assumed that drivers 105*a* and 105*b* are each a distance A from the centerpoint (CP), and that drivers 110*a* and 110*b* are each a distance B from the centerpoint (CP). It can be seen from inspection given the symmetrical arrangement of drivers that the moment M1 generated by the motion of driver 110*a* is $-B \times F$ which cancels the moment M4$=B \times F$ generated by the motion of driver 110*b*, and the moment M2 generated by the motion of driver 105*a* is $-A \times F$ which cancels the moment M3$=A \times F$ generated by the motion of driver 105*b*. The moments of drivers 105*a*, 105*b* facing one direction cancel one another, and likewise the moments of drivers 110*a*, 110*b* facing the other direction also cancel one another.

Thus, in the arrangement of FIG. 10, not only do the upward and downward forces generated by the drivers 105*a*, 105*b*, 110*a*, 110*b* completely cancel out, but also the rotational moments of the drivers 105*a*, 105*b*, 110*a*, 110*b* likewise cancel out, due in this case to the carefully selected symmetrical arrangement of the drivers 105*a*, 105*b*, 110*a*, 110*b*. As a result, the speaker 100 experiences significantly reduced vibration even though it has a number of drivers spaced in a linear array, without necessarily dividing the drivers into pairs directly facing one another.

In practice, small adjustments may be made, if necessary, to account for the center of mass of drivers 105*a*, 105*b*, 110*a*, or 110*b* being off-center from the central plane 135 passing through the centerpoint (CP) and/or asymmetrically positioned with respect to one another. Such adjustments may, for example, be in the form of altering the size or mass of the driver or coil (since the output force of a driver is directly proportional to its moving mass), or changing the amplitude of the electrical audio signal provided to a given driver.

Figure 2:
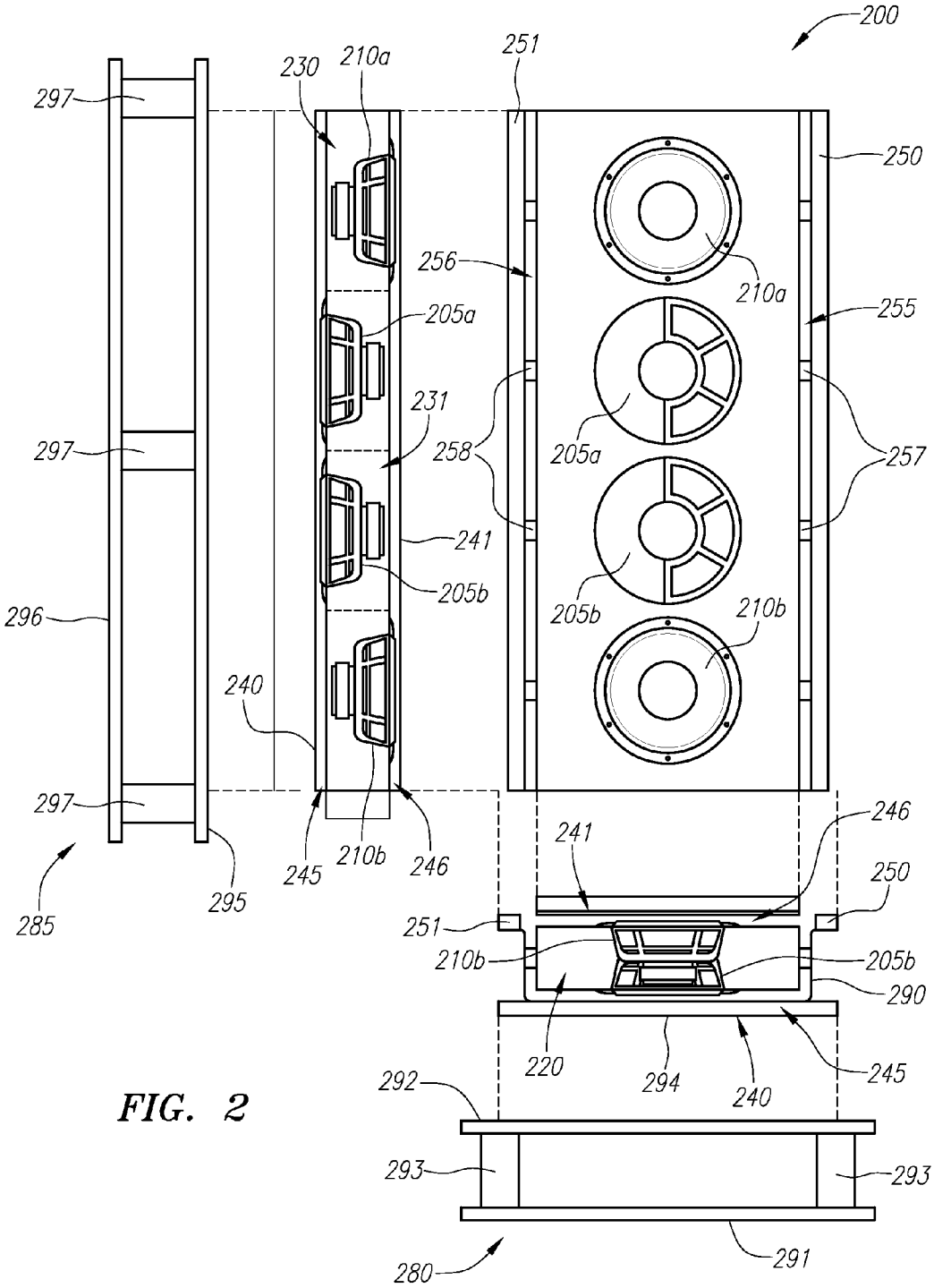
FIG. 2 is an exploded view diagram of a slim-profile sub-woofer speaker constructed according to the general principles of FIGS. 1A-1C, showing additional details.

FIG. 2 illustrates, from various perspectives, a slight variation of the slim-profile subwoofer speaker shown in FIGS. 1A-1C. In FIG. 2, elements numbered "2xx" generally correspond to the like elements numbered "1xx" in FIGS. 1A-1C. Thus, the speaker 200 in FIG. 2 includes four drivers 205*a*, 205*b*, 210*a*, 210*b* arranged in a linear array, with two of the drivers 205*a*, 205*b* mounted on a first baffle 230 of a main speaker enclosure 220 and the other two drivers 210*a*, 210*b* mounted on a second baffle 231 of the main speaker enclosure 220. The first pair of drivers 205*a*, 205*b* output sound towards a first sound-reflecting surface 240 (which may be the speaker backwall), while the second pair of drivers 210*a*, 210*b* output sound towards a second sound-reflecting surface 241 (which may be a speaker front panel). The main speaker enclosure 220 is part of a larger speaker cabinet which, in this example, includes a speaker housing frame 290 in the general shape of a rectangular box, connected to the main speaker enclosure 220 via sets of struts 257, 258, and having a first lip supporting a bottom frame member 251 and a second lip on the opposite side supporting a top frame member 250 (with top and bottom in this case being arbitrarily defined, with the speaker 100 oriented such that the drivers are in a lateral horizontal array). The bottom 240 of the speaker housing frame 290 is attached to a speaker back panel 240.

In this particular example, additional speaker frame components are provided for additional mechanical support, mounting assist, or aesthetics. For example, top/bottom speaker frame assemblies 285 may be affixed to the top and bottom portions of the speaker 200, and side speaker frame assemblies 280 may be affixed to the two side portions of the speaker 200. Top/bottom speaker frame assemblies 285 may include lengthwise supports 295, 296 connected together by cross supports 297, while side speaker frame assemblies 280 may include lengthwise supports 291, 292 connected together by cross-supports 293. The speaker housing frame 290 may be constructed of a rigid lightweight material such as aluminum or another metal or alloy, or any other suitable material, while the top/bottom speaker frame assemblies 285 and side speaker frame assemblies 280 may be constructed of wood, plastic, or composite materials, potentially with metal components (such as supports 297 or 293) or reinforcement.

The same concepts as described above can be applied to speakers having a different number and arrangement of drivers, which may be placed symmetrically or asymmetrically so long as the forces and moments preferably cancel about a centerpoint or center of gravity. In addition, the drivers need not all be of the same size, but can be selected to be of different sizes with a corresponding effect on the magnitude of the output force generated by the driver. Likewise, the same strength signal need not be applied to each of the drivers, but some drivers may receive an amplified or reduced strength signal which will, in turn, affect the magnitude of the output force generated by the driver.

Figure 3A:
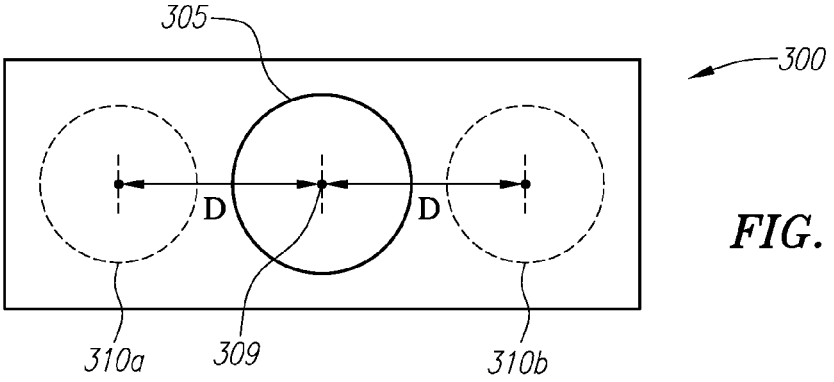
FIGS. 3A and 3B are front and side view diagrams, respectively, of an embodiment of a slim-profile sub-woofer speaker having three drivers.
Figure 3B:
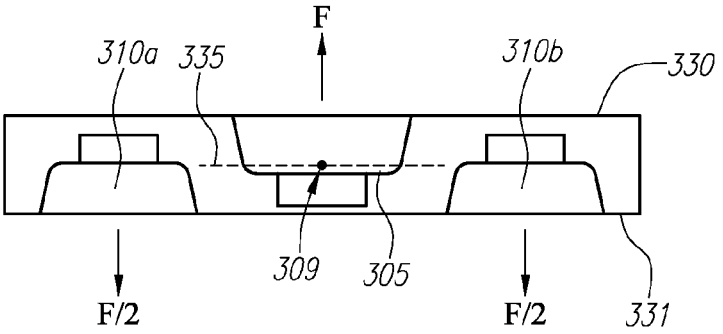

FIGS. 3A-3B, 4A-4B, 6A-6B, 7A-7B, 8, and 9A-9B all illustrate different speaker designs and driver arrangements that show the diverse variety of implementations possible when applying the inventive concepts as disclosed herein. For example, FIGS. 3A and 3B are front and side view diagrams, respectively, of another embodiment of a slim-profile sub-woofer speaker 300, in this case having three drivers 305, 310*a*, and 310*b* arranged in a linear array. In this embodiment, a single driver 305 is mounted on a first baffle 330 of a speaker 300, while the other two drivers 310*a*, 310*b* are mounted on a second baffle 331. The first driver 305 is centered on the centerpoint 309 of the speaker 300 facing one direction, while the other two drivers 310*a*, 310*b* are spaced symmetrically to either side a distance D from the centerpoint 309 facing the opposite direction from the first driver 305, although all three drivers 305, 310*a*, 310*b* lie in the same general lateral plane 335 similar to the embodiment in FIGS. 1A-1C. Although not explicitly shown, each of the drivers 305, 310*a*, 310*b* is preferably acoustically isolated in terms of rearward acoustic radiation from the others via separate sub-chambers within the speaker enclosure.

The sizes (and hence moving mass) of the drivers 305, 310*a*, 310*b* and/or the amplitudes of their respective audio signals are preferably selected so that the force F generated by the first driver 305 is double the force F/2 generated by the pair of drivers 310*a*, 310*b* facing the opposite direction. As a result, the forces of the first driver 305 cancel the sum of the forces generated by the pair of drivers 310*a*, 310*b* facing the opposite direction. To accomplish this, the mass of the coils and moving components of drivers 310*a*, 310*b*, for example, may be selected to be half the mass of the coil and moving components of driver 305, which will result in the generated force of drivers 310*a*, 310*b* being half that of driver 305. Alternatively, the drivers 310*a*, 310*b* may be the same size as driver 305 but receive an audio driving signal that is reduced in amplitude relative to that received by driver 305, thus leading to a reduced force. Specifically, since in general the generated force $F=m\times A$, where m=moving mass of the coil and other components and A=acceleration thereof, an adjustment to the acceleration of the driver through a change in the signal magnitude will adjust the force generated of the driver. In this case, the amplitude of the signals for drivers 310*a*, 310*b* is selected so that the displacement of the drivers 310*a*, 310*b* when moving is half the displacement of driver 305, thus leading to half the generated force.

Alternatively, the force generated by drivers 310*a*, 310*b* may be tailored to be half the force of driver 305 by a combination of reduced mass of the moving coil or components and a reduced amplitude signal, although in this case the calculations may be slightly more involved.

Similarly, the moments generated by all of the drivers 305, 310*a*, 310*b* of speaker 300 cancel so that the sum of the moments is equal to zero. Because driver 305 is located along the center axis of the speaker 300 running through centerpoint 309, driver 305 has a moment of zero. Drivers 310*a* and 310*b* each generate a moment equal to D×F/2, but of opposite sign since they are on opposite sides of centerpoint 309; therefore, the moments generated by drivers 310*a* and 310*b* cancel one another, leading to a sum of all of the moments of zero.

Thus, with the speaker 300 of FIGS. 3A and 3B, the sum of the forces of all of the drivers 305, 310*a*, 310*b* collectively cancel out to zero, and the sum of the moments likewise cancels out to zero.

Figure 4A:
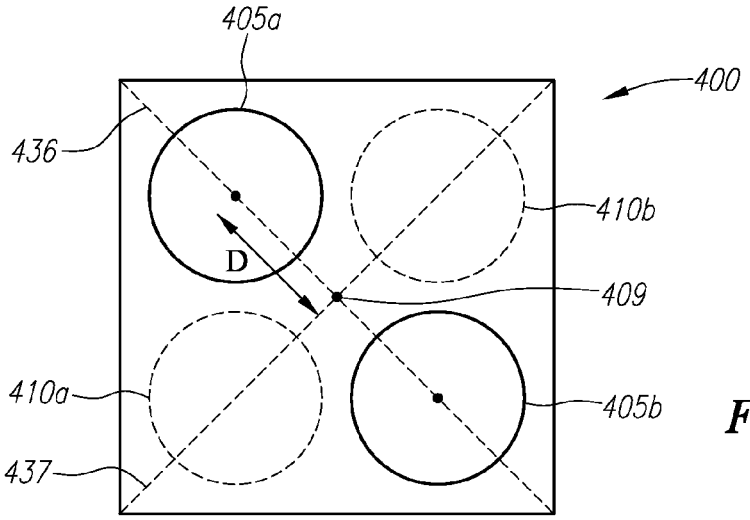
FIGS. 4A and 4B are front and side view diagrams, respectively, of an embodiment of a slim-profile sub-woofer speaker having four drivers.
Figure 4B:
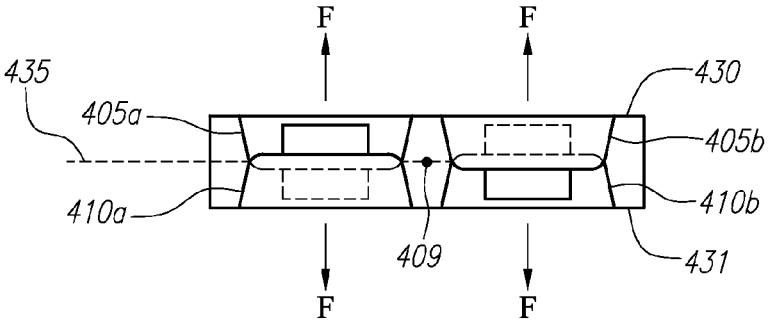

Another embodiment of a slim-profile sub-woofer speaker is illustrated in FIGS. 4A and 4B, which show front and side view diagrams, respectively, of a speaker 400 having four drivers. In FIGS. 4A and 4B, the speaker 400 has a first pair of drivers 405*a*, 405*b* mounted on a first baffle 430, while the other two drivers 410*a*, 410*b* are mounted on a second baffle 431 of the speaker 400. The four drivers 405*a*, 405*b*, 410*a*, 410*b* in this example are arranged symmetrically in a substantially square pattern, with the first pair of drivers 405*a*, 405*b* arranged across one diagonal 436 of the square, and the other pair of drivers 410*a*, 410*b* arranged across the other diagonal 437 of the square, although all four drivers 405*a*, 405*b*, 410*a*, 410*b* lie in the same general lateral plane 435. Although not explicitly shown, each of the drivers 405*a*, 405*b*, 410*a*, 410*b* is preferably acoustically isolated in terms of rearward acoustic radiation from the others via separate sub-chambers within the speaker enclosure.

The sizes (and hence moving mass) of the drivers 405*a*, 405*b*, 410*a*, 410*b* and the amplitudes of their respective audio signals may all be identical, so that the force F generated by each driver is the same. As a result, the sum of the forces generated by the first pair of drivers 405*a*, 405*b* cancel the sum of the forces generated by the second pair of drivers 410*a*, 410*b* facing the opposite direction, for a total net force of zero. Similarly, the moments generated by all of the drivers 405*a*, 405*b*, 410*a*, 410*b* of speaker 400 cancel so that the net sum of the moments is equal to zero. Drivers 405*a*, 405*b* each generate a moment equal to D×F relative to the diagonal 436, but of opposite sign since they are on opposite sides of centerpoint 409; therefore, the moments generated by drivers 405*a* and 405*b* cancel one another. Likewise, drivers 410*a*, 410*b* each generate a moment equal to D×F relative to the diagonal 437, but of opposite sign since they are on opposite sides of centerpoint 409; therefore, the moments generated by drivers 410*a* and 410*b* cancel one another, leading to a net sum of all of the moments of zero.

Thus, with the speaker 400 of FIGS. 4A and 4B, the sum of the forces of all of the drivers 405*a*, 405*b*, 410*a*, 410*b* collectively cancel out to zero, and the sum of the moments likewise cancels out to zero.

It may be noted that the speaker designs in FIGS. 4A-4B and FIGS. 5A-5B each utilize four drivers, but have a different arrangement of the drivers. Nonetheless, in each case, using the design principles disclosed herein, the speaker may be constructed so that the net sum of the forces of all drivers is zero, and that the net sum of the moments generated by all drivers is zero.

Figure 6A:
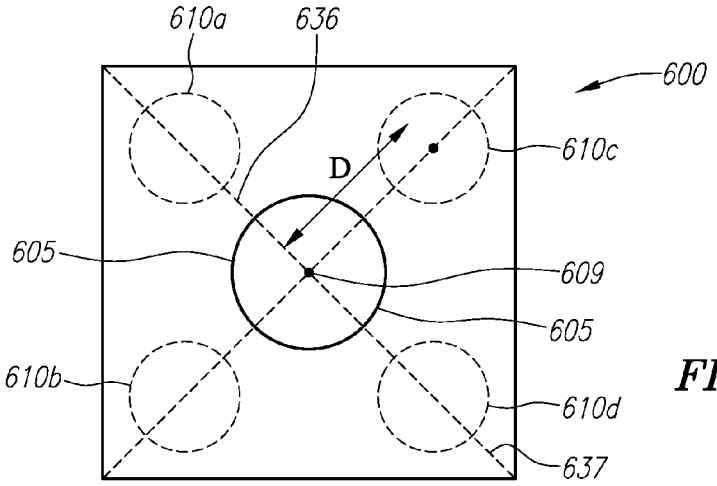
FIGS. 6A and 6B are front and side view diagrams, respectively, of an embodiment of a slim-profile sub-woofer speaker having five drivers.
Figure 6B:
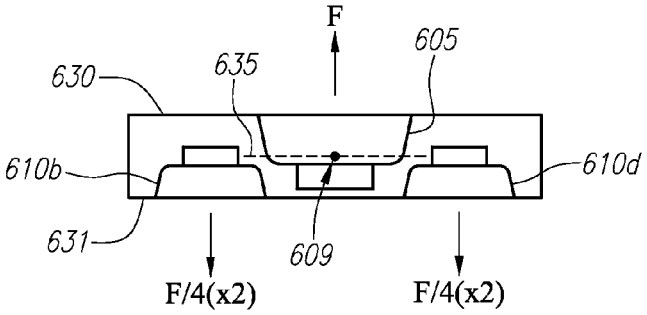

Yet another embodiment of a slim-profile sub-woofer speaker is illustrated in FIGS. 6A and 6B, which show are front and side view diagrams, respectively, of a speaker 600 having five drivers 605, 610*a*, 610*b*, 610*c*, 610*d*. In the design of FIGS. 6A and 6B, the speaker 600 has a first driver 605 mounted on a first baffle 630, with a set of four drivers 610*a*, 610*b*, 610*c*, 610*d* mounted on a second baffle 631 of the speaker 600. The single driver 605 mounted on the first baffle 630 in this example is centrally located, while the set of four drivers 610*a*, 610*b*, 610*c*, 610*d* are arranged symmetrically in a substantially square pattern, with one pair of drivers 610*a*, 610*d* arranged across one diagonal 636 of the square, and the other pair of drivers 610*b*, 610*c* arranged across the other diagonal 637 of the square, although all five drivers 605, 610*a*, 610*b*, 610*c*, 610*d* lie in the same general lateral plane 635. Although not explicitly shown, each of the drivers 605, 610*a*, 610*b*, 610*c*, 610*d* is preferably acoustically isolated in terms of rearward acoustic radiation from the others via separate sub-chambers within the speaker enclosure.

The sizes (and hence moving mass) of the drivers 605, 610*a*, 610*b*, 610*c*, 610*d* and/or the amplitudes of their respective audio signals are preferably selected so that the force F generated by the first driver 605 is four times the force F/4 generated by the set of four drivers 610*a*, 610*b*, 610*c*, 610*d* facing the opposite direction. As a result, the forces of the first driver 605 cancel the sum of the forces generated by the set of four drivers 610*a*, 610*b*, 610*c*, 610*d* facing the opposite direction. To accomplish this, the mass of the coils and moving components of drivers 610*a*-610*d* for example, may be selected to be one-fourth of the mass of the coil and moving components of driver 605, which will result in the generated force of each of drivers 610*a*, 610*b*, 610*c*, 610*d* being one-quarter that of driver 605. Alternatively, the drivers 610*a*, 610*b*, 610*c*, 610*d* may be the same size as driver 605 but receive an audio driving signal that is reduced in amplitude relative to that received by driver 605, thus leading to a reduced force. As yet another alternative, the force generated by drivers 610*a*, 610*b*, 610*c*, 610*d* may be tailored to be one-quarter the force of driver 605 by a combination of reduced mass of the moving coil or components and a reduced amplitude signal.

Similarly, the moments generated by all of the drivers 605, 610*a*, 610*b*, 610*c*, 610*d* of speaker 600 cancel so that the net sum of the moments is equal to zero. Because driver 605 is located along the center axis (on the centerpoint 609) of the speaker 600, its moment is equal to zero. Drivers 610*a*, 610*d* each generate a moment equal to D×F/4 relative to the diagonal 636, but of opposite sign since they are on opposite sides of centerpoint 609; therefore, the moments generated by drivers 615*a* and 610*d* cancel one another. Likewise, drivers 610*b*, 610*c* each generate a moment equal to D×F/4 relative to the diagonal 637, but of opposite sign since they are on opposite sides of centerpoint 609; therefore, the moments generated by drivers 610*b* and 610*c* cancel one another, leading to a net sum of all of the moments of zero.

Thus, with the speaker 600 of FIGS. 6A and 6B, the sum of the forces of all of the drivers 605, 610*a*, 610*b*, 610*c*, 610*d* collectively cancel out to zero, and the sum of the moments likewise cancels out to zero.

Figure 7A:
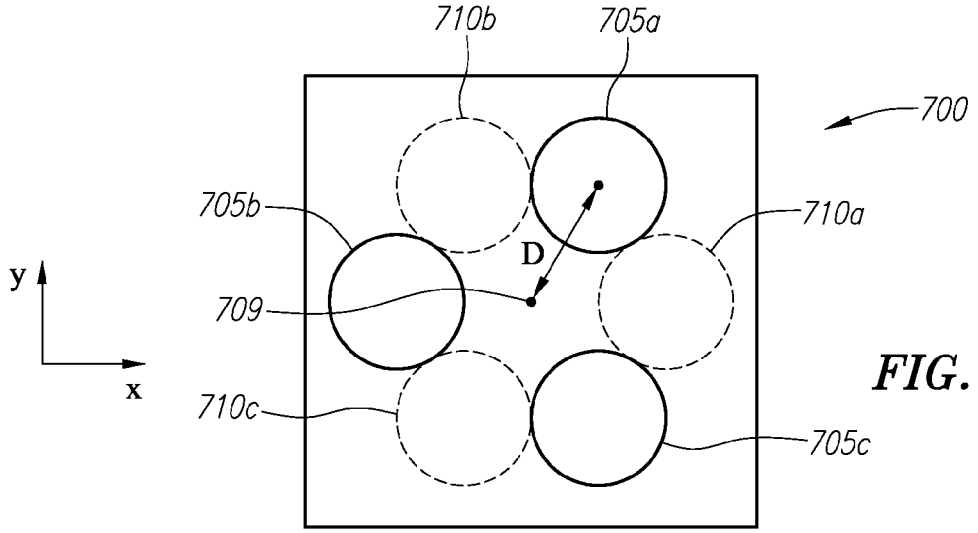
FIGS. 7A and 7B are front and side view diagrams, respectively, of an embodiment of a slim-profile sub-woofer speaker having six drivers.
Figure 7B:
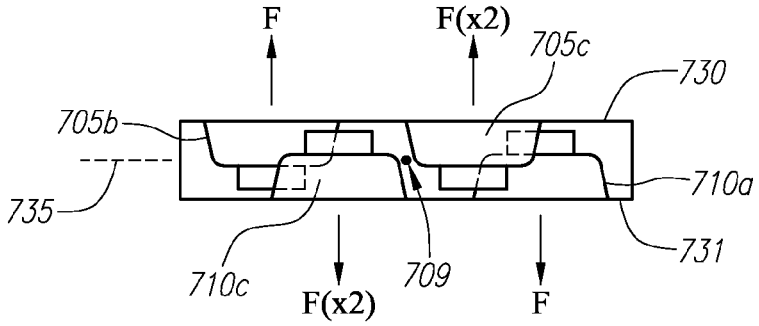

Another embodiment of a slim-profile sub-woofer speaker is illustrated in FIGS. 7A and 7B, which show front and side view diagrams, respectively, of a speaker 700 having six drivers. In the design of FIGS. 7A and 7B, the speaker 700 has a first set of drivers 705*a*, 705*b*, 705*c* mounted on a first baffle 730, and another set of drivers 710*a*, 710*b*, 710*c* mounted on a second baffle 731 of the speaker 700. The six drivers 705*a*, 705*b*, 705*c*, 710*a*, 710*b*, 710*c* in this example are arranged symmetrically in a substantially hexagonal (or more generally a circular) pattern, with the first set of drivers 705*a*, 705*b*, 705*c* arranged in a generally equilateral triangle shape, and the other set of drivers 710*a*, 710*b*, 710*c* arranged in a similar equilateral triangle shape offset from the first equilateral triangle as shown (i.e., with the apexes of both equilateral triangles pointing the opposite directions), although all six drivers 705*a*, 705*b*, 705*c*, 710*a*, 710*b*, 710*c* lie in the same general lateral plane 735. Although not explicitly shown, each of the drivers 705*a*, 705*b*, 705*c*, 710*a*, 710*b*, 710*c* is preferably acoustically isolated in terms of rearward acoustic radiation from the others via separate sub-chambers within the speaker enclosure.

The sizes (and hence moving mass) of the drivers 705*a*, 705*b*, 705*c*, 710*a*, 710*b*, 710*c* and the amplitudes of their respective audio signals may all be identical, so that the force F generated by each driver is the same. As a result, the sum of the forces generated by the first set of three drivers 705*a*, 705*b*, 705*c* cancel the sum of the forces generated by the second set of three drivers 710*a*, 710*b*, 710*c* facing the opposite direction, for a total net force of zero. Similarly, the moments generated by all of the drivers 705*a*, 705*b*, 705*c*, 710*a*, 710*b*, 710*c* of speaker 700 cancel so that the net sum of the moments is equal to zero. Preferably the speaker 700 is hexagonal in shape or circular, so as to avoid any residual moments that may otherwise be created due to asymmetry of the six drivers 705*a*, 705*b*, 705*c*, 710*a*, 701*b*, 701*c* relative to the square shape of the speaker 700 as presently shown; for purposes of simplification, such residual moments are disregarded although they may be eliminated as noted by making the shape of the speaker 700 symmetrical relative to each driver. In any event, taking the x-y coordinate system as shown in FIG. 7A, and recognizing that the vector cross product of $a \times b = (a_2b_3 - a_3b_2,\ a_3b_1 - a_1b_3,\ a_1b_2 - a_2b_1)$, driver 705*b* generates a moment M1=(−D,0,0)×F and driver 710*a* generates a moment M4=(D,0,0)×−F, where F=(0,0,f) summing to (0, 2D·f, 0), which is canceled by the sum of the moments:

M2=(D·cos 60°, D·sin 60°, 0)×(0,0,f), generated by driver 705*a*

M3=(D·cos 60°, −D·sin 60°, 0)×(0,0,f), generated by driver 705*c*

M5=(−D·cos 60°, D·sin 60°, 0)×(0,0,−f), generated by driver 710*b*

M6=(−D·cos 60°, −D·sin 60°, 0)×(0,0,−f), generated by driver 710*c* where F=(0,0,f), that is, a force perpendicular to the speaker 700 with no x or y lateral component. The four moments generated by drivers 705*a*, 705*c*, 710*b* and 710*c* can be determined as follows:

M2=(D·f·sin 60°, −D·f·cos 60°, 0), generated by driver 705*a*

M3=(−D·f·sin 60°, −D·f·cos 60°, 0), generated by driver 705*c*

M5=(−D·f·sin 60°, −D·f·cos 60°, 0), generated by driver 710*b*

M6=(D·f·sin 60°, −D·f·cos 60°, 0), generated by driver 710*c* and their vector sum is:

$$((2\cdot D\cdot f\cdot \sin 60° - 2\cdot D\cdot f\cdot \sin 60°, -4\cdot D\cdot f\cdot \cos 60°, 0) = (0, -4/2D\cdot f, 0) = (0, -2D\cdot f, 0)$$

which exactly counter-acts and cancels the sum of the moments generated by drivers 705*b* and 710*a*.

Thus, with the speaker 700 of FIGS. 7A and 7B, the sum of the forces of all of the drivers 705*a*, 705*b*, 705*c*, 710*a*, 710*b*, 710*c* collectively cancel out to zero, and the sum of the moments likewise cancels out to zero.

Figure 8:
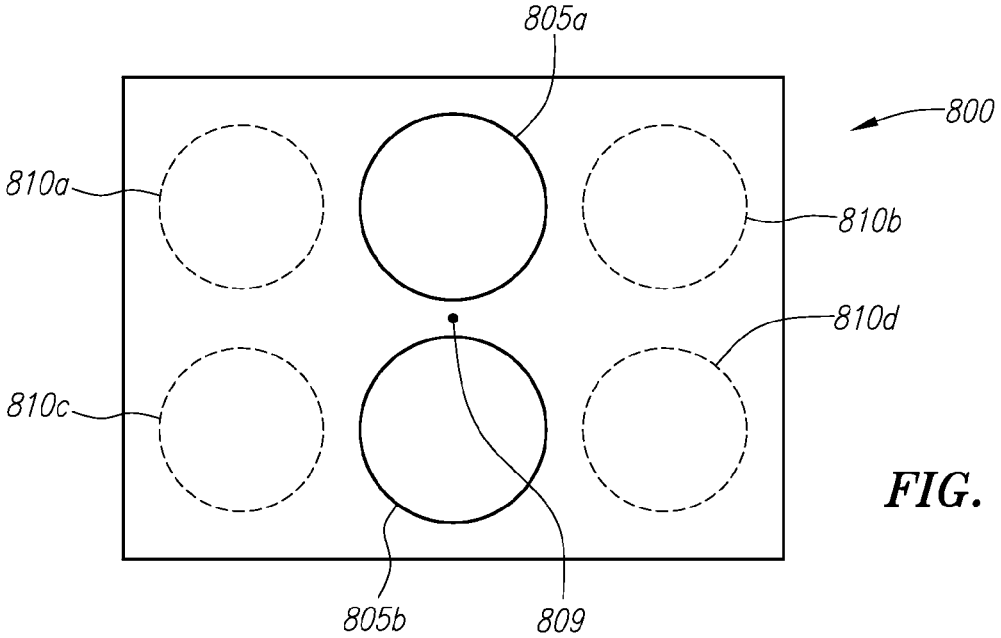
FIG. 8 is a front diagram of another embodiment of a slim-profile sub-woofer speaker having six drivers.

Another embodiment of a slim-profile sub-woofer speaker is illustrated in FIG. 8, which shows a front view diagram of a speaker 800 having six drivers. In the design of FIG. 8, the speaker 800 has a first pair of drivers 805*a*, 805*b* mounted on a first (top) baffle, while the other four drivers 810*a*, 810*b*, 810*c*, 810*d* are mounted on a second (bottom) baffle of the speaker 800, which appears in side cross-section the same as speaker 300 shown in FIG. 3B (and thus is not shown as a separate figure in connection with FIG. 8). The first two drivers 805*a*, 805*b* in this example are arranged symmetrically with respect to center-point 809, and likewise the set of four drivers 810*a*, 810*b*, 810*c*, 810*d* facing the opposite direction are arranged in a symmetrical substantially rectangular pattern, although, as with the embodiments before, all six drivers 805*a*, 805*b*, 810*a*, 810*b*, 810*c*, 810*d* lie in the same general lateral plane when viewed from the side (as in FIG. 3B). Although not explicitly shown, each of the drivers 805*a*, 805*b*, 810*a*, 810*b*, 810*c*, 810*c* is preferably acoustically isolated in terms of rearward acoustic radiation from the others via separate sub-chambers within the speaker enclosure.

The sizes (and hence moving mass) of the drivers 805*a*, 805*b*, 810*a*, 810*b*, 810*c*, 810*d* and/or the amplitudes of their respective audio signals are preferably selected so that the forces F generated by the first pair of drivers 805*a*, 805*b* is double the force F/2 generated by the set of four drivers 810*a*, 810*b*, 810*c*, 810*d* facing the opposite direction. As a result, the sum of the forces of the first pair of drivers 805*a*, 805*b* cancel the sum of the forces generated by the second set of drivers 810*a*, 810*b*, 810*c*, 810*d* facing the opposite direction. To accomplish this, the drivers may be selected so that the mass of the coils and moving components of each of drivers 810*a*, 810*b*, 810*c*, 810*d*, for example, is half the mass of the coil and moving components of either of drivers 805*a*, 805*b*, or else the drivers may all be the same size but drivers 810*a*, 810*b*, 810*c*, 810*d* may receive an audio driving signal of reduced amplitude relative to that received by drivers 805*a*, 805*b*, as previously explained in connection with FIGS. 3A-3B, or else some combination of variation in moving mass and audio signal adjustment may be made to cause the forces to be appropriately tailored.

Similarly, the moments generated by all of the drivers 805*a*, 805*b*, 810*a*, 810*b*, 810*c*, 810*d* of speaker 800 cancel so that the sum of the moments is equal to zero. Because of the symmetrical arrangement in this case, the moments generated by drivers 805*a* and 805*b* about the centerpoint 809 cancel, and the moments generated by drivers 810*a*, 810*d* are canceled by the moments generated by drivers 810*b*, 810*c*, leading to a net sum of moments of zero.

Thus, with the speaker 800 of FIG. 8, the sum of the forces of all of the drivers 305, 310*a*, 310*b* collectively cancel out to zero, and the sum of the moments likewise cancels out to zero.

In one aspect, the speaker 800 of FIG. 8 may be viewed as two speakers 300 of FIGS. 3A-3B placed side-by-side, and, using a similar principle, larger speaker structures may be extrapolated to relatively larger and more complex sub-woofer speaker designs.

It may be noted that the speaker designs in FIGS. 7A-7B and FIG. 8 each utilize six drivers, but have a different arrangement of the drivers. Nonetheless, in each case, using the design principles disclosed herein, the speaker may be constructed so that the net sum of the forces of all drivers is zero, and that the net sum of the moments generated by all drivers is zero.

Figure 9A:
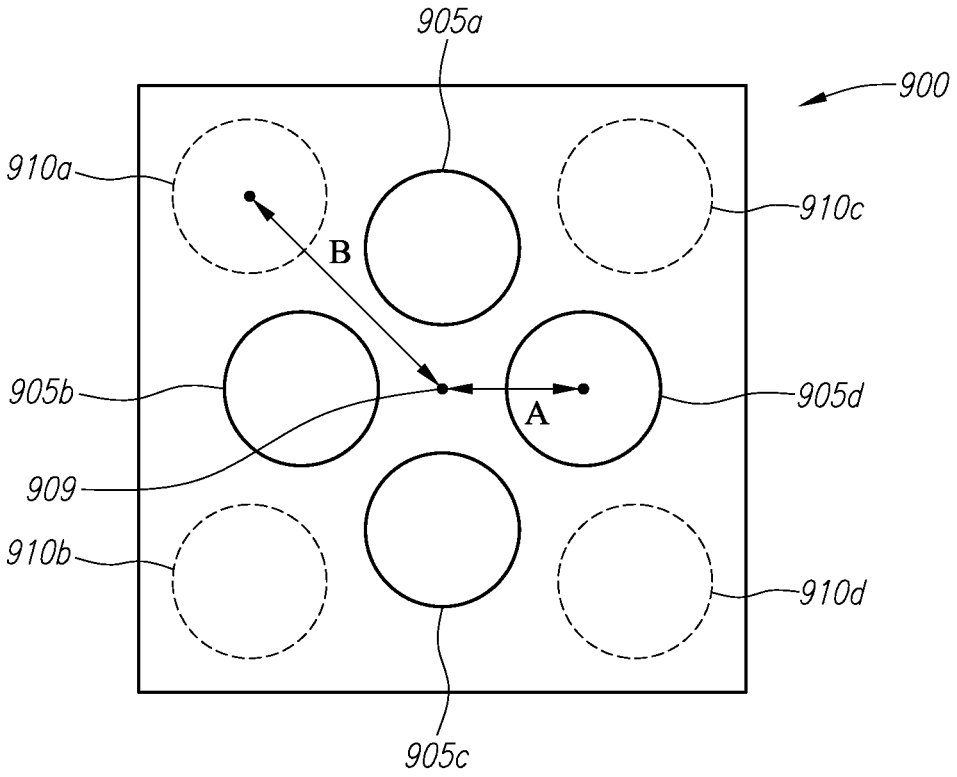
FIGS. 9A and 9B are front and side view diagrams, respectively, of an embodiment of a slim-profile sub-woofer speaker having eight drivers.
Figure 9B:
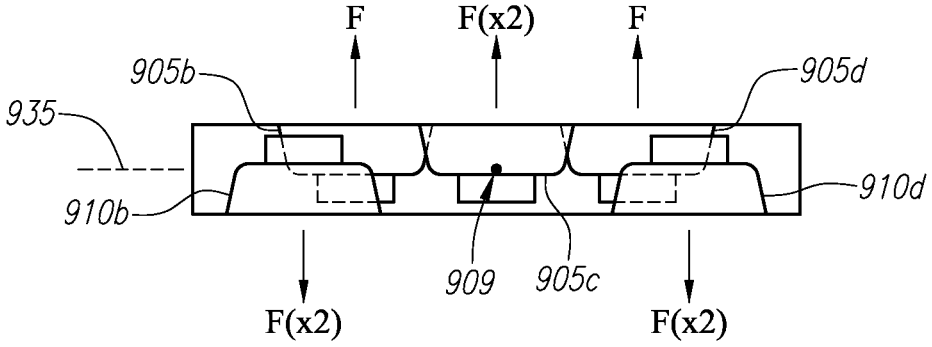

Another embodiment of a slim-profile sub-woofer speaker is illustrated in FIGS. 9A and 9B, which show front and side view diagrams, respectively, of a speaker 900 having eight drivers. In FIGS. 9A and 9B, the speaker 900 has a first set of four drivers 905*a*, 905*b*, 905*c*, 905*d* mounted on a first baffle 930, and another set of four drivers 910*a*, 910*b*, 910*c*, 910*d* mounted on a second baffle 931 of the speaker 900. The first set of drivers 905*a*, 905*b*, 905*c*, 905*d* are arranged in a substantially square and symmetrical pattern relative to the centerpoint 909, and the other set of four drivers 910*a*, 910*b*, 910*c*, 910*d* facing the opposite direction are likewise arranged in a substantially square and symmetrical pattern relative to the centerpoint 909, although all eight drivers 905*a*-905*d*, 910*a*-910*d* lie in the same general lateral plane 935. Although not explicitly shown, each of the drivers 905*a*-905*d* and 910*a*-910*d* is preferably acoustically isolated in terms of rearward acoustic radiation from the others via separate sub-chambers within the speaker enclosure. While the square patterns of four drivers in this case are rotationally offset from one another by ninety degrees, this is not a requirement, and the square patterns can be aligned so that they appear as an inner square of four drivers surrounded by a conforming outer square of four drivers.

The sizes (and hence moving mass) of the drivers 905*a*-905*d*, 910*a*-910*d* and the amplitudes of their respective audio signals may all be identical, so that the force F generated by each driver is the same. As a result, the sum of the forces generated by the first set of drivers 905*a*-905*d* cancel the sum of the forces generated by the second set of drivers 910*a*-910*d* facing the opposite direction, for a total net force of zero.

Similarly, due to the symmetrical arrangement in this particular design, the moments generated by all of the drivers 905*a*-905*d*, 910*a*-910*d* of speaker 900 cancel so that the net sum of the moments is equal to zero. Drivers 905*a* and 905*c* each generate a moment equal to A×F but with opposite signs, thus canceling; drivers 905*b* and 905*d* also each generate a moment equal to A×F but with opposite signs, thus canceling; drivers 910*a* and 910*d* each generate a moment equal to B×F but with opposite signs, thus canceling; and drivers 910*b* and 910*c* also each generate a moment equal to B×F but with opposite signs, thus canceling.

Thus, with the speaker 900 of FIGS. 9A and 9B, the sum of the forces of all of the drivers 905*a*-905*d*, 910*a*-910*d* collectively cancel out to zero, and the sum of the moments likewise cancels out to zero.

According to one or more embodiments as disclosed herein, a balanced subwoofer or other speaker is provided that may, if desired, have a relatively narrow profile thus giving it advantages in terms of placement, as well as having reduced vibrations, rattling, etc., thus improving listening experience. The speaker is preferably balanced in that the forces generated by the drivers sufficiently cancel so that vibration, rattling, etc. is eliminated or at least reduced below a tolerable level. For example, the drivers may be arranged such that the sum of the forces associated with the drivers is below a first threshold, and a sum of the moments associated with the drivers is below a second threshold, where the first and second thresholds are selected to provide a given tolerance to vibration, rattling, etc. More preferably, the drivers are oriented such that the net sum of the forces associated with all of the drivers substantially equals zero, and the net sum of the moments from all of the drivers about a centerpoint or center of mass of the speaker substantially equals zero. The net sum of the forces or moments may substantially equal zero when the resulting net force or moment is insufficient to cause vibration, rattling, etc. discernable to an ordinary listener or observer.

A subwoofer or other similar speaker may include, for example, in various embodiments, a number of drivers placed side by side in the same general plane, with a first set of drivers facing one direction and second set of drivers facing the opposite direction. The drivers in such a case may be oriented such that the sum of the forces from the first set of drivers is equal to and opposite from the sum of the forces from the second set of drivers with the total vector sum of the forces from all of the drivers equaling zero, and such that the vector sum of the moments from all of the drivers about a centerpoint or center of mass of the speaker collectively equals zero.

A subwoofer or other speaker according to certain principles described herein may include any number of drivers, with a minimum of three drivers being used in certain embodiments to ensure that the moment created between two opposing offset drivers can be canceled through the addition of at least one additional offset driver. For example, a subwoofer or other speaker may include three, four, five, six, or even more drivers. The speaker need not be symmetric in shape, but can be asymmetrical so long as the forces and moments are such that they cancel about the centerpoint or center of mass of the speaker. Similarly, while the drivers are preferably arranged in the same general plane, they may alternatively be arranged in a three-dimensional pattern so long as the forces and moments are such that they cancel about the centerpoint of the speaker. The drivers may all be arranged in a single linear array, but alternatively may be arranged in a preferably (but not necessarily) symmetric pattern about the center of mass of the speaker. Either an even or odd number of drivers may be used, so long as the forces and moments are preferably balanced to reduce vibrations or rattling of the speaker.

In some embodiments, a first set of drivers and second set of drivers lie in the same general plane but face opposite from one another. Each set of drivers may output sound towards a reflective surface which in turn directs the sound outward from an adjacent slot or aperture. A speaker enclosure may be constructed with a connected aperture so that sound from the two sets of drivers is combined and emanates from a single aperture or set of apertures common to both sets of drivers.

In certain embodiments, a subwoofer or other speaker is constructed with a lightweight but rigid and sturdy enclosure in which the walls are formed in part from a frame overlaid with acoustically opaque material. For example, the enclosure may include a frame comprising a series of frame supports arranged in a repeating pattern, such as a honeycomb pattern, overlaid with an acoustically opaque material such as resilient foam or other such material. Within the speaker enclosure, each driver (or set of drivers) may have its (or their) own isolated enclosure, so that the rearward acoustic radiation of a driver does not interfere with the acoustic output of any other driver.

Embodiments as disclosed herein may be employed in a variety of applications, and may be particularly well suited for situations in which it is desired to conceal speakers from view, or in which audio systems face restrictions with respect to, for example, speaker locations or installation area. A slim-profile balanced subwoofer speaker constructed according to embodiments disclosed herein may, for example, be installed in a building wall, ceiling or floor, or may be employed in an automobile, or in other locations in which it is desired to have a relatively narrow speaker yet have reduced vibration or greater output. In certain embodiments, arrays of oppositely facing drivers may be mounted on a pair of baffles forming part of a speaker enclosure, yet within the same general lateral plane, with a first set of drivers outputting sound into a first sound duct and a second set of drivers outputting sound into a second sound duct. The sound ducts in such an embodiment may be joined at one or more common output apertures, so that both sets of drivers output sound from the same one or more apertures.

In any of the embodiments described herein, the speakers utilized in the sound system may be passive or active in nature (including with built-in or on-board amplification capability). The various audio channels may be individually amplified, level-shifted, boosted, or otherwise conditioned appropriately for each individual speaker or pair of speakers. In some embodiments, the audio signal(s) to the various drivers may be processed and/or delayed to ensure, for example, that the sound waves generated by each speaker's audio output reinforce rather than interfere with one another, or to make other such adjustments. The subwoofer or other speaker may be in connection with other drivers, such as tweeters, in addition to the balanced drivers to further enhance the sound quality experienced by the listener, particularly if such additional drivers have a negligible effect on the vibrations of the speaker enclosure because they are very small or generate minimal forces. The speaker configuration may be advantageously employed in applications such as houses, buildings, automobiles, sound stages, musical instrument amplifiers, and so on, or any application in which a low speaker profile may be advantageous or desirable.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. A loudspeaker, comprising: a speaker assembly; and a plurality of drivers at least three in number mounted on said speaker assembly in a same plane of said speaker assembly, each driver being associated with a magnet reaction force and with a moment based in part on its position relative to a center of mass of said speaker assembly; wherein said drivers are laterally mutually offset from one another relative to said center of mass of said speaker assembly, and arranged such that the forces and moments associated with the drivers mounted on said speaker assembly substantially cancel vibrations of the speaker.

2. The loudspeaker of claim 1, wherein the sum of the forces associated with all of the drivers mounted on said speaker assembly is substantially equal to zero, and a sum of the moments associated with all of the drivers is substantially equal to zero.

3. The loudspeaker of claim 2, wherein each of said drivers has a cone, at least two of said drivers radiating in opposite directions, and wherein the cones of said at least two drivers overlap in the same lateral plane.

4. The loudspeaker of claim 1, wherein said drivers lie in substantially the same lateral plane.

5. The loudspeaker of claim wherein said plurality of drivers comprises a first set of drivers facing a first direction, and a second set of drivers facing a second direction.

6. The loudspeaker of claim 5, wherein said first direction is opposite said second direction.

7. The loudspeaker of claim 6, wherein said first set of drivers are mounted on a first mounting surface and said second set of drivers are mounted on a second mounting surface, said first mounting surface and said second mounting surface parallel to one another, said loudspeaker further comprising a first sound reflecting surface disposed in front of said first set of drivers and substantially parallel with said first mounting surface and a second sound reflective surface disposed in front of said second set of drivers and substantially parallel with said second mounting surface.

8. The loudspeaker of claim 7, wherein the first mounting surface and first sound reflecting surface collectively define a first sound duct terminating in at least one sound output aperture, and the second mounting surface and second sound reflecting surface collectively define a second sound duct terminating in said at least one sound output aperture, whereby the acoustic output from the first set and second set of drivers emanates from the at least one sound output aperture.

9. The loudspeaker of claim 5, wherein said first set of drivers are symmetrically arranged relative to said center of mass.

10. The loudspeaker of claim 5, wherein said first set of drivers are arranged asymmetrically relative to said center of mass.

11. The loudspeaker of claim 5, wherein said plurality of drivers are arranged in a single linear array.

12. The loudspeaker of claim 1, wherein all of the drivers are substantially identical in terms of moving mass and receive the same audio signal.

13. The loudspeaker of claim 1, wherein at least two of said drivers are different sizes.

14. The loudspeaker of claim 1, wherein at least two of said drivers receive audio signals of different magnitude but having the same frequency content in order to balance the forces or moments among all of said drivers relative to the center of mass of the speaker assembly.

15. The loudspeaker of claim 1, wherein each of said plurality of drivers is a subwoofer.

16. A slim profile speaker, comprising:

a first mounting surface and a second mounting surface substantially parallel to one another and mechanically coupled;

a first set of drivers disposed on said first mounting surface; and a second set of drivers disposed on said second mounting surface and radiating in an opposite direction compared to said first set of drivers, at least one of said second set of drivers being laterally offset from all of the first set of drivers;

wherein each driver is associated with a magnet reaction force related to its forward and rearward notion and with a moment resulting from the driver's force and position relative to a center of mass of said speaker; and wherein said drivers are arranged such that the aggregate forces and moments of the first set and second set of drivers substantially cancel.

17. The slim profile speaker of claim 16, wherein said first set and second set of drivers are arranged such that a sum of the forces associated with all of the drivers is substantially equal to zero, and a sum of the moments associated with all of the drivers is substantially equal to zero.

18. The slim profile speaker of claim 17, wherein said first mounting surface is coextensive in size with said second mounting surface.

19. The slim profile speaker of claim 17, wherein:

a rear side of said first set of drivers faces said second mounting surface; and a rear side of said second set of drivers faces said first mounting surface;

whereby said first set of drivers and said second set of drivers face away from one another.

20. The slim profile speaker of claim 19, wherein said first set of drivers and said second set of drivers each have a cone lying in substantially the same lateral plane.

21. The slim profile speaker of claim 20, wherein said first set of drivers and said second set of drivers are arranged in a single linear array.

22. The slim profile speaker of claim 16, wherein said first set of drivers consists of a single driver, and wherein said second set of drivers consists of a pair of drivers facing the opposite direction from said single driver.

23. The slim profile speaker of claim 16, wherein said first set of drivers consists of a first pair of drivers symmetrically spaced about the speaker's center of mass, and where said second set of drivers consists of a second pair of drivers symmetrically spaced about the speaker's center of mass.

24. The slim profile speaker of claim 23, wherein said second pair of drivers are spaced more widely from the speaker's center of mass than said first pair of drivers and face the opposite direction thereto, and wherein said first pair and second pair of drivers are arranged in a single linear array.

25. The slim profile speaker of claim 23, wherein said first pair and second pair of drivers are arranged in a substantially rectangular pattern, said first pair of drivers positioned across a first diagonal of said rectangular pattern, and said second pair of drivers positioned across a second diagonal of said rectangular pattern and facing the opposite direction from said first pair of drivers.

26. The slim profile speaker of claim 25, wherein said first pair and second pair of drivers are arranged in a substantially square pattern.

27. The slim profile speaker of claim 16, wherein said first set of drivers consists of a single driver, and wherein said second set of drivers consists of four drivers facing an opposite direction from said single driver and arranged in a substantially rectangular pattern.

28. The slim profile speaker of claim 27, wherein said second set of drivers are arranged in a substantially square pattern.

29. The slim profile speaker of claim 16, wherein said first set of drivers consists of three drivers arranged in a first equilateral triangle, and where said second set of drivers consists of three drivers arranged in a second equilateral triangle facing an opposite direction from said first set of drivers.

30. The slim profile speaker of claim 16, wherein said first set of drivers consists of four drivers arranged in a first substantially rectangular pattern, and where said second set of drivers consists of four drivers arranged in a second substantially rectangular pattern facing an opposite direction from said first set of drivers.

31. The slim profile speaker of claim 16, wherein rearward acoustic radiation from each of the drivers in said first set and said second set of drivers is acoustically isolated from the other drivers.

32. The slim profile speaker of claim 16, wherein all of the drivers of said first set and second set of drivers are substantially identical in terms of moving mass and receive the same audio signal.

33. The slim profile speaker of claim 16, wherein at least two of the drivers of said first set and second set of drivers are different sizes.

34. The slim profile speaker of claim 16, wherein at least two of the drivers of said first set and second set of drivers receive audio signals of different magnitude but similar in frequency content in order to balance the forces or moments among all of said drivers relative to the center of mass of the speaker.

35. The slim profile speaker of claim 16, wherein each of the drivers of said first set and second set of drivers is a subwoofer.

36. The slim profile speaker of claim 16, further comprising a first sound reflecting surface disposed in front of said first set of drivers and substantially parallel with said first mounting surface and a second sound reflective surface disposed in front of said second set of drivers and substantially parallel with said second mounting surface.

37. The slim profile speaker of claim 36, wherein the first mounting surface and first sound reflecting surface collectively define a first sound duct terminating in at least one sound output aperture, and the second mounting surface and second sound reflecting surface collectively define a second sound duct terminating in said at least one sound output aperture, whereby the acoustic output from the first set and second set of drivers emanates from the at least one sound output aperture.

38. A balanced subwoofer speaker, comprising:

a speaker assembly; and a plurality of subwoofer drivers of at least three in number mounted on said speaker assembly, each subwoofer driver being associated with a magnet reaction force generated by its forward and rearward motion and with a moment resulting from the driver's force and position relative to a center of mass of said speaker assembly;

wherein said subwoofer drivers lie in substantially he same lateral plane, and are arranged such that an aggregate sum of the forces associated with all of the subwoofer drivers mounted on said speaker assembly is substantially equal to zero, and an aggregate sum of the moments associated with all of the subwoofer drivers is substantially equal to zero.

39. The balanced subwoofer speaker of claim 38, wherein said speaker assembly comprises a first mounting surface and a second mounting surface substantially parallel to one another and mechanically coupled, wherein a first group of said plurality of subwoofer drivers is disposed on said first mounting surface, and a second group of said plurality of subwoofer drivers is disposed on said second mounting surface and face an opposite direction from said first group of subwoofer drivers.

40. The balanced subwoofer speaker of claim 39, wherein:

said first group of subwoofer drivers faces away from second mounting surface; and said second group of subwoofer drivers faces away from said first mounting surface.

41. The balanced subwoofer speaker of claim 40, wherein said first group of subwoofer drivers and said second group of subwoofer drivers are arranged in a single linear array.

42. The balanced subwoofer speaker of claim 40, further comprising a first sound reflecting surface disposed in front of said first group of subwoofer drivers and substantially parallel with said first mounting surface and a second sound reflective surface disposed in front of said second group of subwoofer drivers and substantially parallel with said second mounting surface, whereby the acoustic output from the first group and second group of subwoofer drivers is combined and emanates from at least one common sound output aperture.

* * * * *